United States Patent [19]

Compton

[11] 4,452,001

[45] Jun. 5, 1984

[54] FIRING PIN MECHANISM

[76] Inventor: Robert Compton, Box 3492, San Angelo, Tex. 76901

[21] Appl. No.: 252,446

[22] Filed: Apr. 9, 1981

[51] Int. Cl.[3] ..... F41C 11/04

[52] U.S. Cl. ..... 42/23; 42/69 R

[58] Field of Search ..... 42/23, 69 A, 69 R, 46, 42/47

[56] References Cited

U.S. PATENT DOCUMENTS

| | | | |
|---|---|---|---|
| 38,455 | 5/1863 | Aldrich . | |
| 185,721 | 12/1876 | Borchardt | 42/23 |
| 193,060 | 7/1877 | Wesson . | |
| 206,217 | 7/1878 | Borchardt . | |
| 414,797 | 11/1889 | Comstock | 42/69 R |
| 465,354 | 12/1891 | Davenport . | |
| 592,239 | 10/1897 | Davenport . | |
| 1,448,297 | 3/1923 | Hedrick . | |
| 2,289,098 | 7/1942 | Buhmiller | 42/23 |
| 2,765,559 | 10/1956 | Morris | 42/23 |
| 3,619,930 | 11/1971 | Beermann et al. | 42/69 R |
| 3,710,493 | 1/1973 | Gramiger | 42/23 |
| 3,735,517 | 5/1973 | De Hass | 42/23 |
| 3,830,000 | 8/1974 | Browning | 42/23 |
| 4,040,196 | 8/1977 | Smith | 42/23 |
| 4,126,079 | 11/1978 | Perrine | 42/69 A |
| 4,128,956 | 11/1978 | Foote | 42/23 |

FOREIGN PATENT DOCUMENTS 735 7/1877 Fed. Rep. of Germany .

*Primary Examiner*—Charles T. Jordan
*Assistant Examiner*—Ted L. Parr
*Attorney, Agent, or Firm*—Thomas L. Cantrell; Joseph H. Schley; Stanley R. Moore

[57] ABSTRACT

The present invention relates to improvements in firing and cocking mechanism of a breach loading firearm. This invention utilizes a substantially massive pin block disposed in a horizontal track between two counter biasing springs, the main spring and the counter spring. A firing pin extends from the chamber end of the pin block. When the cocked pin block is released, the main spring drives it toward the chamber and the momentum of the moving pin block carries the extended firing into contact with the primer of the cartridge despite the resistance of the counter spring. Lowering the breechblock allows a spring loaded ejector plate to spring backward and pull the spent cartridge casing from the chamber. In addition the ejector plate strikes a projection of the pin block and drives the pin block back to the cocked position. An extension of a lever which operates the action returns the ejector plate to the chamber so that the breechblock is able to rise unobstructed. Lost motion pivots connecting this lever to the breechblock provide the timing whereby one return stroke of the lever sequentially seats the ejector and raises the breechblock. The trigger release mechanism for this firearm is simply constructed from a very limited number of ruggedly manufactured parts.

7 Claims, 8 Drawing Figures

FIRING PIN MECHANISM

BACKGROUND OF THE INVENTION

Firearms are used in widely varied environments. An action constructed of a minimum number of elements and that eliminates delicate and intricate elements is most dependable under the severest of these.

Accuracy is another immediately evident constraint and it is preferred that a cartridge be fired by a firing pin striking in line with the trajectory of the bullet. Such motion is superior to an angled firing pin or a rotating hammer in that, other factors being equal, it promotes sure and repeatable alignment of the cartridge within the chamber throughout firing.

In addition it is preferred that no channel be provided backward through the action which would allow escaping powder to discharge into the user's face upon firing a cartridge with a gas leak.

Each of these aspects is addressed by a firearm constructed in accordance with the present invention.

SUMMARY OF THE INVENTION

The present invention utilizes a substantially massive pin block disposed in a horizontal track between two counter biasing springs, the main spring and the counter spring. The firing pin extends from one end of the pin block and the counter spring engages this end of the pin block to bias the firing pin away from the immediate area of the chamber. A relatively stronger spring, the main spring, is deployed on the opposite end of the pin block and biases the pin block and extended firing pin toward the chamber. In action, the pin block horizontally travels in a track through the breechblock along the concurrent axes of the counter and main springs.

In addition, the pin block is biased at right angles to the main spring—counter spring axis. A third spring, the catch spring, preferbly engages the top of the pin block and biases it downward, toward a sear which is itself biased toward the pin block by a forth spring, the trigger spring.

In the preferred embodiments, a trigger assembly pivots about a post in the breechblock to reach the sear. The sear is upwardly biased against the pin block by the trigger spring and the pin block is notched to receive the trigger sear. Alternative trigger assemblies are also disclosed.

The trigger assembly, trigger sear, pin block and assorted springs are set within the breechblock which is disposed for vertical movement within the breech housing. The breech housing is set between the chamber and the rear stock of the firearm and frames the vertical slot through which the breechblock moves.

A lever action is disposed beneath the breechblock and is attached thereto by a pivotal link. The lever itself is pivotally connected to the firearm at a position forward of the breechblock. A return bar extends from the lever at a position behind the pivot point and is disposed to engage the ejector which is biased away from the chamber by the ejector spring.

The action of the present invention causes the firing pin to strike the primer and fire the cartridge in a relatively direct manner. Cocked, the pin block is held against the force of the compressed main spring by the sear which is received into a recess in the pin block. The sear is pushed into the reception of the pin block by the trigger spring. Preferably, the pin block itself is urged toward the sear by a catch spring disposed on the opposite side of the pin block. This catch spring secures engagement of the sear to the pin block despite the loose tolerances of the apertures within which the pin block horizontally moves. In the preferred embodiment the trigger assembly pivots about a post to pull the sear downward, out of engagement, when the trigger is pulled against the force of the trigger spring. Thus, pulling the trigger releases the pin block which is propelled horizontally by the main spring. The relative strengths and dispositions of the opposing main and counter springs force the pin block to move rapidly toward the chamber upon release and the momentum developed by the traveling pin block carries the extended firing pin into sharp contact with the primer of the cartridge. After the momentum of the travelling pin block is absorbed in impact with the primer, the counter spring rebounds the firing pin and holds it at a distance slightly removed from the cartridge. In this position the firing pin does not interfere with the vertical motion of the breechblock.

Working the lever expells the spent cartridge case, cocks the action, seats a live cartridge and returns the breechblock to a firing position.

Pulled down, the lever pivots about its forward connection to the firearm and lowers the link which is pivotally connected to both the lever and the breechblock through a limited lost motion double pivot. At the limit of the lost motion, the link member engages to pull the breechblock below the level of the chamber. At the bottom of the swing the chambering face of the block falls below the path of the ejector plate. This same motion of the lever swings the return bar away from the chamber and allows the ejector to spring backward pulling the spent cartridge from the chamber. The ejector spring propels the ejector plate with sufficient velocity to throw the spent cartridge against a deflecting plate which directs the path of the cartridge to clear the firearm. The ejector plate is also propelled with sufficient force to push the pin block back against the force of the main spring. The sear engages the pin block to retain it in the cocked position against the compression of the main spring.

Raising the lever carries the retainer bar forward which engages the ejector plate and pushes it forward. When a live cartridge is in the chamber to the extent allowed by the extended ejector assembly, the return bar chambers the shell with the return of the ejector plate. After the return bar has seated the ejector plate, and the cartridge is in place, the pivoting link reaches the limit of its return lost motion and further lifting of the lever raises the breechblock and brings the cocked firing pin into alignment with the primer of the shell. The firearm is now again ready to fire.

A BRIEF DESCRIPTION OF THE DRAWING

FIG. 1 is a fragmentary cross sectional side elevational view of the present invention in a cocked, ready to fire, position;

FIG. 2 is a fragmentary cross sectional side elevational view of the present invention as the firearm is fired;

FIG. 3 is a fragmentary cross sectional side elevational view of the present invention viewed as the spent shell is ejected and the pin block is again cocked;

FIG. 4 is a fragmentary cross sectional side elevational view of the present invention viewed just after a new cartridge has been placed in the chamber;

FIG. 5 is a fragmentary cross sectional side elevational view of the present invention viewed just as the shell is seated in the chamber;

DETAILED DESCRIPTION OF THE DRAWING

Figure 1:
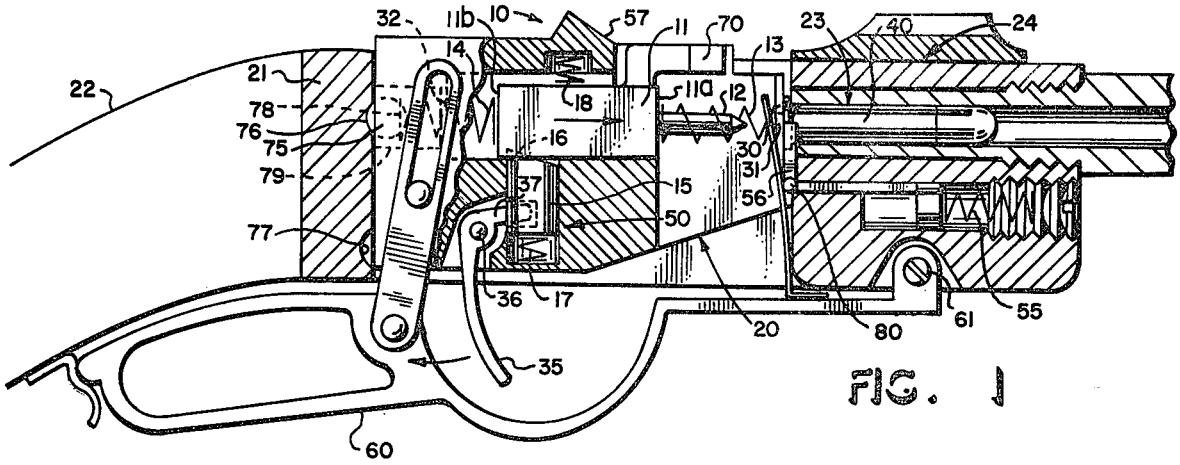
FIG. 1 through FIG. 5 are temporally sequential views illustrating the use of a firearm constructed in accordance with the present invention.

A firearm embodying this present invention is designated generally as 10. It is a lever actuated breech loading device having breechblock 20 set in breech housing 21 between chamber 23 of receiver 24 and rear stock 22. See FIG. 1.

The mechanism of the present invention employs a substantially massive pin block 11 from which firing pin 12 extends. The pin block is disposed for horizontal movement within an aperture defining a track in breechblock 20 between two opposing and horizontally aligned springs, the main spring 14 and counter spring 13. The weaker of these springs, counter spring 13, is deployed on chamber on firing pin end 11*a* of elongated pin block 11 and seats against the inside of chamber face wall 30 of breechblock 20. Thus situated, the counter spring biases firing pin 12 away from aperture 31 in the chamber face wall of breechblock 20. It is through aperture 31 that the firing pin reaches the primer of cartridge 40. Main spring 14 is deployed on end 11*b* of pin block 11 opposite the firing pin. The main spring is set between the pin block and back wall 32 of breechblock 20 to bias the firing pin toward the cartridge. The main spring is the driving spring in the firing of the firearm.

In the cocked position, pin block 11 is held in place against the force of the compressed main spring by trigger assembly 50. In FIGS. 1 through 5 the trigger assembly includes sear 15, trigger 35, post 36, trigger spring 17, and trigger arm 37. This assembly secures the firing pin by the engagement with the pin block 11. Trigger spring 17 biases sear 15 into this engagement with the pin block. The pin block is released when the sear is withdrawn against the force exerted by the trigger spring. This is accomplished by pulling trigger 35 in a conventional manner. The substantially horizontal displacement of the trigger is translated about pivot post 36 to a substantially vertical displacement at the extended end of trigger arm 37. Pivot post 36 is fixed in relation to the breechblock. Trigger arm 37 is so connected with sear 15 that the vertical lowering of the end of the trigger arm works against the bias of the trigger spring and withdraws the sear from engagement with notch 16.

To further secure this engagement, catch spring 18 is preferbly employed to bias the pin block downward, toward the sear. Deploying the catch spring allows greater tolerances in the engagement of pin block 11 within the horizontal aperture which forms a track for the pin block within breechblock 20. This controlled tolerance is employed to discourage the freezing of the action. However, thus controlled, the firing pin strikes the cartridge in a uniformly repeatable manner.

Figure 7:
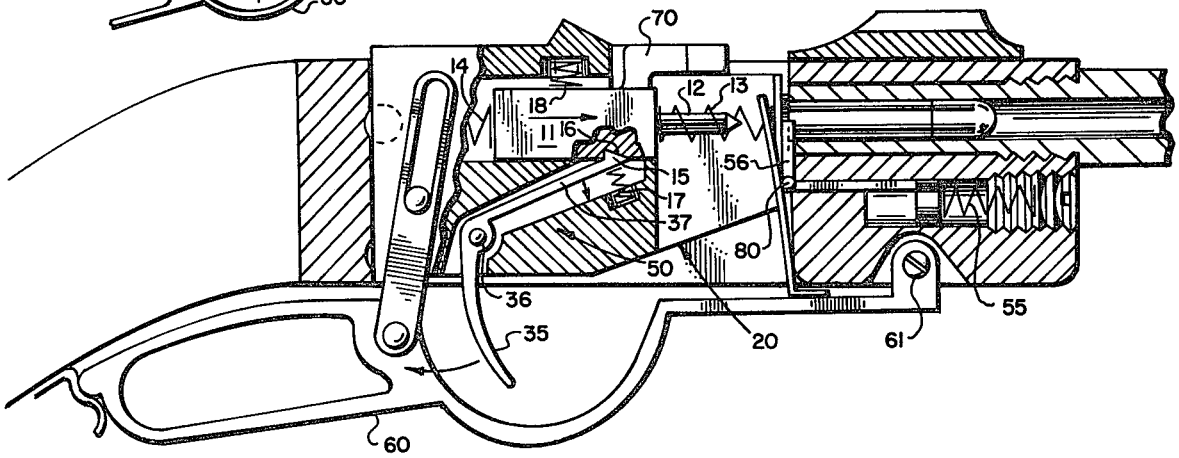
FIG. 7 is a fragmentary cross sectional side elevational view of an alternative trigger assembly for a firearm constructed in accordance with the present invention.

In FIG. 1 the sear is an element separate from the trigger arm. There the sear is disposed in a vertical slot. FIG. 7 illustrates an alternate configuration for the trigger assembly where the sear is formed integrally with the trigger arm. Either configuration results in a direct and reliable trigger release mechanism.

Figure 8:
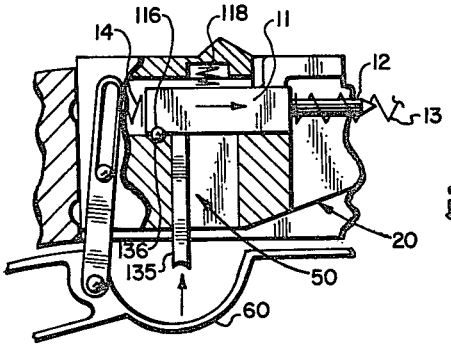
FIG. 8 is a fragmentary cross sectional side elevational view of another alternative trigger assembly constructed in accordance with the present invention.

FIG. 8 is yet another trigger assembly configuration. However, in this configuration no pivot point is necessary to transform horizontal motion to vertical motion because vertical motion is input. This configuration uses trigger prod 135 which is connected to and preferably unitary with pin block 11. Post 136 is fixed in relation to breechblock 20. Notch 116 of the pin block engages post 136 and is biased toward the post by catch spring 118. This engagement is released by directly applying an upward thrust to trigger prod 135.

Figure 2:
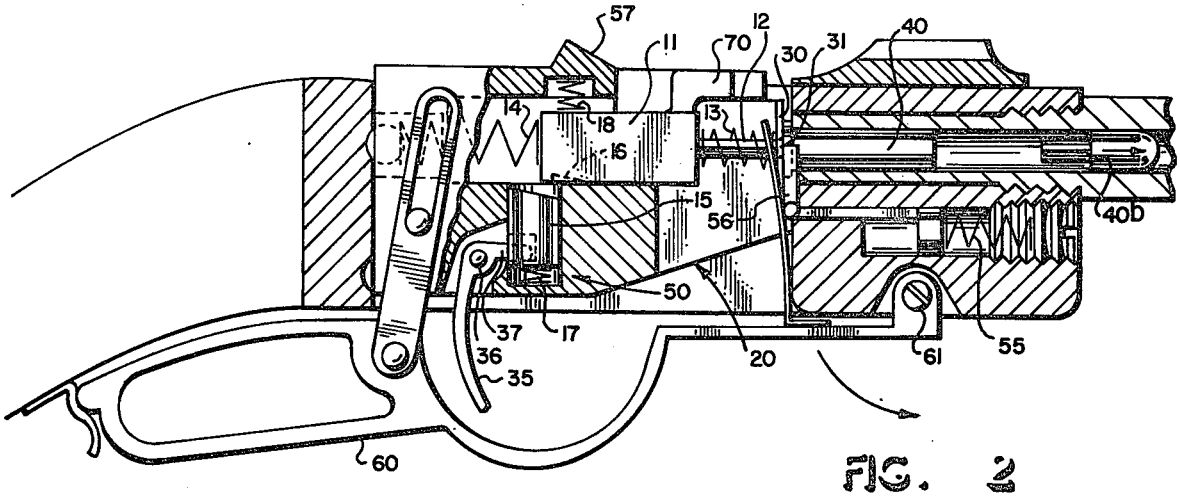

FIG. 2 illustrates the firearm as bullet 40*b* is fired. Sear 15 has been withdrawn from pin block 11 and main spring 14 has propelled the pin block toward cartridge 40. The mass of the pin block results in the development of significant momentum as the firing pin darts forward. It is this momentum that allows the firing pin to carry forward despite counter spring 13 and to penetrate aperture 31 and sharply contact the primer of cartridge 40. It should be noted that the enclosement of the firing pin within the breechblock does not provide an aperture through which leaking gas might be directed toward the user's face and eyes. The most likely avenue for such expulsion is between vertical chamber face wall 30 of the breechblock and the chamber itself and such a configuration will not discharge gas and powder toward the user's eyes in the event a defective cartridge casing is used. After the momentum of the travelling pin block is spent in impact between the firing pin and the primer, the firing pin rebounds into aperture 31 biased by counter spring 13. It is only in this region immediately adjacent the chamber that counter spring 13 is controlling over main spring 14. The firing pin is withdrawn from the striking position in this manner so that it does not interfere with the lowering of the breechblock.

Figure 3:
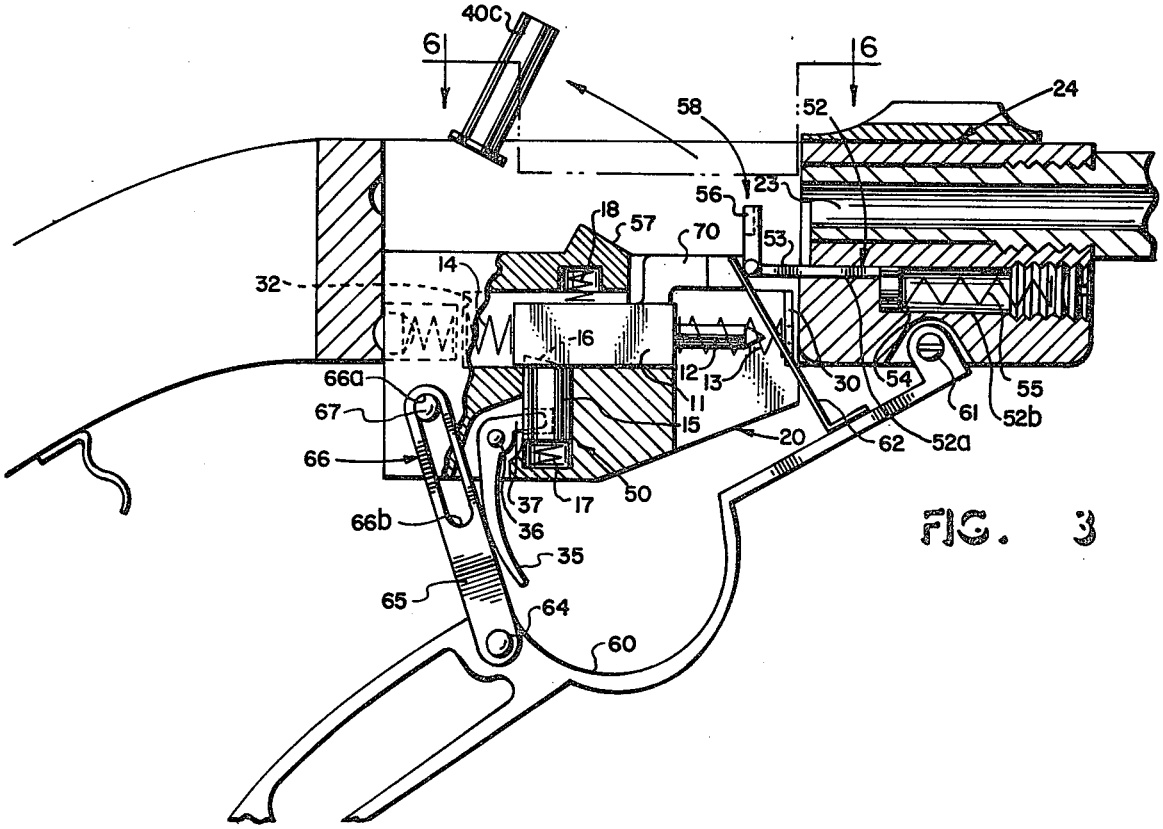

FIG. 3 illustrates the ejection of a spent cartridge and the cocking of the mechanism. Lever 60 is hinged forward of the breechblock at pivot 61. Return bar 62 is cantilevered into the action from lever 60 and pivot link 65 is attached to lever 60 at pivot 64. Pivot link 65 provides a limited lost motion connection between lever 60 and breechblock 20 to which it is connected at post 67. In this embodiment pivot link 65 is connected to post 67 through limited slide 66 having stops 66*a* and 66*b*.

Lever 60 is lowered to eject spent cartridge 40*c*. Swinging lever 60 downward swings cantilevered return bar 62 away from the chamber and when link 65 has been lowered so that stop 66*a* engages post 67, link 65 pulls the breechblock down in the vertical slot formed by breech housing 21. Ejector plate 56 is free to spring away from the chamber once chamber face wall 30 of breechblock 20 is pulled below the level of chamber 23.

Ejector plate 56 is propelled rearward by ejector spring 55 pushing on plunger end 54 of stem 53. The other end of spring 55 engages stop 51. The stem is set in aperture 52 in receiver 24. This aperture is disposed adjacent the chamber 23 and substantially parallel to it. It is preferred that the aperture has two regions, 52*a* and 52*b*, the first (52*a*) being the wider region where the plunger end of the stem and the ejector spring slide, the second (52*b*) being a narrower region rearward of the first through which a thinner portion of the stem reciprocates. This aperture configuration serves to limit the rearwardly extending freedom of the ejector plate by retaining the plunger end in the first or forward region of aperture 52. Thus, when the path of ejector plate 56 is clear, spring 55 drives the ejector plate rearwardly away from chamber 23, extending it on stem 53. Together these elements make up ejector assembly 58.

The rim of cartridge 40 is set behind ejector plate 56 (See FIG. 2) and the released ejector plate extracts cartridge 40*c* from the chamber by pushing on the rim. The spent cartridge is extracted with such velocity that the cartridge is propelled rearward past the limits of the ejector plate's stroke. Once clear of the chamber, the spent cartridge continues to fly rearward to where it strikes deflector plate 57 on breechblock 20 and is thrown clear of the firearm.

Figure 6:
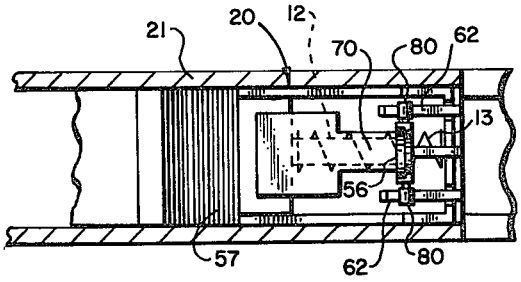
FIG. 6 is a fragmentary cross-sectional top elevational view of the present invention taken along line 6—6 in FIG. 3.

The ejector plate also drives pin block 11 back to the cocked position by engaging pin block arm 70. Pin block arm 70 is an extension of the pin block which rises above the chambering face of the breechblock. When the pin block is driven sufficiently back, notch 16 is presented over sear 15 which engages to secure the cocked position. FIG. 6 is a top view of some of these same elements.

Figure 4:
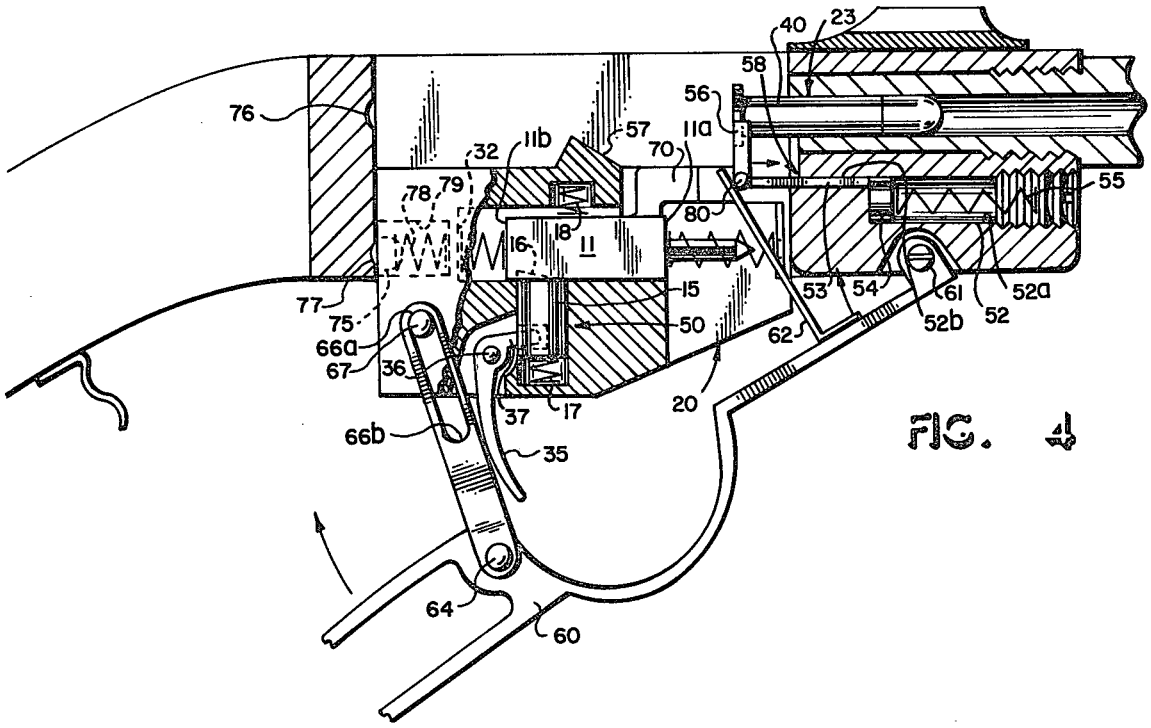
Figure 5:
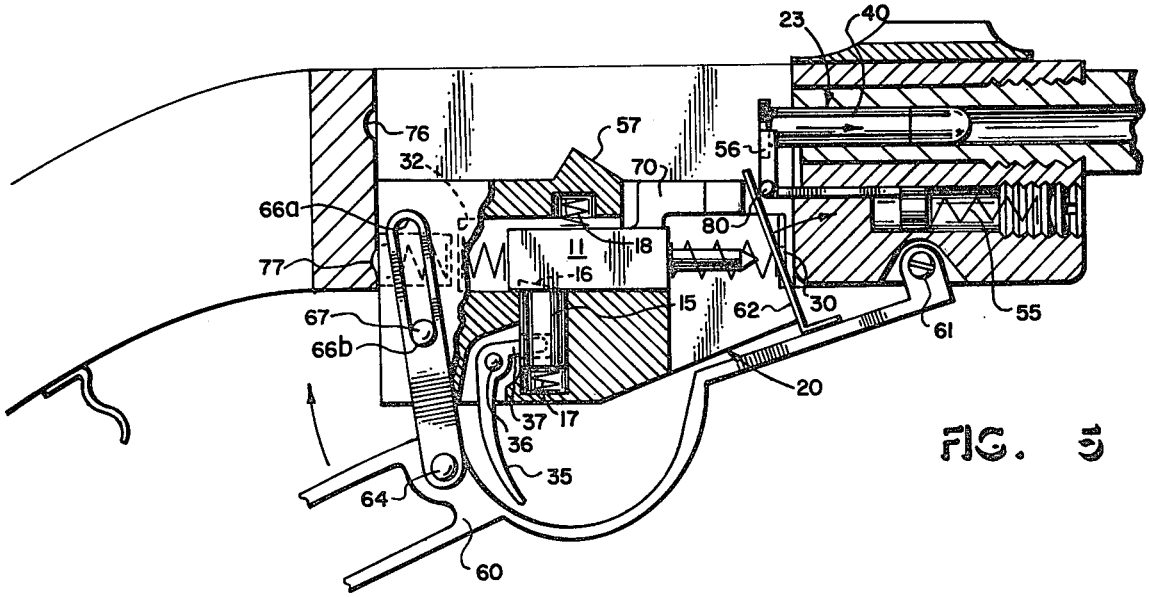

FIG. 4 depicts an initial stage of loading a live cartridge. Cartridge 40 is inserted into chamber 23 to the extent allowed by the ejector plate in its extended position. Note that return bar 62 engages the ejector assembly at the beginning of the lever's return. Further rising of lever 60 seats the ejector plate and cartridge at the chamber. Throughout this position of the lever's return stroke the lost motion provision of pivot link 65 has allowed breechblock 11 to remain stationary until the ejector plate is returned. In FIG. 5 the return of lever 60 has swung return bar 62 almost far enough to fully return ejector plate 56. Simultaneously, pivot link 65 is ending the lost motion swing as stop 66*b* is about to engage post 67 of the breechblock. Further return of the lever rises the breechblock within the breech housing and presents the cocked firing pin to the firing position at the chamber. See FIG. 1. In this manner the lost motion provision of the post 67 pivot link 65 connection allows a single return stroke of the lever to push the ejector plate flush against the chamber and, when these parts have been cleared from the way, to raise the breechblock to the firing position.

FIG. 6 is a cross sectional top view of the preferred embodiment wherein a pair of return bars 62 are disposed on either side of ejector plate 56 engaging roller bearings 80. This configuration reduces the stress on the ejector assembly yet allows proportions condusive to chambering a wide range of calibers into a single action design.

Finally, it is preferred that some additional provision be made to define the limits through which the breechblock rises and falls. Here spring loaded ball 75 engages sockets 76 and 77 of breech housing 21 to limit the swing of the breechblock. Ball 75 is biased by spring 78 and is loaded, together with spring 78 into aperture 79 in breechblock 20.

It should be evident from the foregoing that an action constructed in accordance with the present invention can produce an unusually rugged firearm constructed of a minimal number of elements and no intricate and delicate members.

I claim:

1. A mechanism within a firearm having a falling breechblock action, said breechblock being disposed for vertical reciprocation within a slot defined by the breech housing which is set between a chamber and a rear stock, said chamber being of a configuration to receive a cartridge having a percussion sensitive primer, said mechanism comprising:

an elongated horizontal track within said breechblock;

a back wall of said breechblock closing one end of said elongated horizontal track;

a chamber fore wall of said breechblock opposite said back wall and substantially closing the other end of the elongated horizontal track;

a momentum drivable pin block disposed in said track, said pin block having a chamber end and a back end;

a firing pin extending from the chamber end of said pin block;

an aperture through said chamber fore wall of said breechblock through which said firing pin is extendable into said chamber for striking said primer;

a counter spring disposed in said track between said pin block and said chamber fore wall of said breechblock whereby said firing pin is biased away from the immediate area of said chamber;

a main spring set between the back end of said pin block and the back wall of said elongated horizontal track whereby said main spring, when cocked, exerts a force on said pin block urging it toward the chamber;

a trigger assembly mounted on said breechblock whereby said pin block is first held in a cocked position against the force of said main spring, then released at a selected time to fire the cartridge, being driven first by said main spring and carried through to firing pin-primer impact by the momentum of said travelling pin block;

means for ejecting cartridge after firing, said means comprising:

an ejector plate disposed for seating flush against the chamber, set between the chamber and the chamber fore wall of said breechblock when said breechblock is in a raised position;

said ejector plate being engagable with the rim of a chambered cartridge;

an elongated ejector stem having a plate end to which said ejector plate is connected and a plunger end opposite said plate end, said ejector stem providing a means whereby said ejector plate is horizontally and telescopically extendable away from said chamber; and an ejector spring engaging said ejector stem at its plunger end whereby said ejector stem and attached ejector plate are urged toward an extended position;

whereby, when said breechlock is lowered and the chamber fore wall drops from horizontal alignment with said ejector plate, said ejector plate springs rearward and pulls the cartridge from the chamber after firing;

means for cocking said pin block, said means comprising:

a pin block arm extension of said pin block; and said ejector plate being disposed to engage said pin block arm upon ejecting a cartridge after firing from said chamber and to drive said pin block to its cocked position;

whereby said pin block is driven rearward, against the force of the main spring, by the force of the ejector spring and once pushed back, the trigger assembly engages said pin block to releasably secure the cocked position; means for returning said ejector plate to its seated position; and means to lower and raise said breechblock.

2. A firearm mechanism constructed in accordance with claim 1 wherein said means to lower and raise said breech-block comprises:

a lever action pivotally connected to said firearm forward of said breechblock and disposed underneath said breechblock; and a double pivoting link pivotally connecting said lever and said breechblock;

whereby a downward arc of said lever draws said pivoting link downward which in turn draws said breechblock downward, and an upward swing of said lever pushes the pivoting link upward which raises the breechblock.

3. A firearm mechanism constructed in accordance with claim 2 wherein said means to return said ejector plate to its seated position comprises:

at least one anti-friction element attached to said ejector plate;

an elongated return bar extending from said lever, the extended end of said return bar disposed to engage the anti-friction element of said ejector plate, whereby a pivotal upward swing of said lever passes the extended end of said return bar through a forward arc which drives the ejector plate to its seated position; and said double pivoting link having a lost motion connection with defined upper and lower limits whereby said lever swings free in relation to said breechblock during that portion of said lever's stroke between engagements of said upper and lower limits, thereby allowing a single stroke of said lever to first seat said ejector plate then raise said breechblock.

4. A mechanism within a firearm having a falling breechblock action with a breechblock being disposed for vertical reciprocation within a slot defined by a breech housing which is set between a chamber and a rear stock, said chamber being of a configuration to receive a cartridge having a rim and a percussion sensitive primer, said mechanism comprising:

a firing pin mounting member;

a firing pin projecting from said firing pin mounting member and disposed to selectively strike said primer of said cartridge;

a main spring urging said firing pin toward said chamber;

a trigger assembly whereby said firing pin is selectively releasable from a cocked position to strike said percussion sensitive primer and thereby fire said cartridge;

means for ejecting the cartridge after firing, said means comprising:

an ejector plate disposed for seating flush against the chamber, set between the chamber and a chamber face wall of said breechblock when said breechblock is in a raised position;

said ejector plate being engagable with the rim of a cartridge placed within said chamber;

an elongated ejector stem having a plate end to which said ejector plate is connected and a plunger end opposite said plate end, said ejector stem providing a means whereby said ejector plate is horizontally and telescopically extendable away from said chamber; and an ejector spring engaging said ejector stem at its plunger end whereby said ejector stem and attached ejector plate are urged toward an extended position;

means for cocking said pin block comprising:

an ejector plate engaging face on said firing pin mounting member;

said ejector plate being disposed to engage said firing pin mounting member upon ejecting a cartridge from said chamber after firing and to drive said firing pin mounting member to its cocked position;

whereby said firing pin is driven rearward, against the force of the main spring, by the force of the ejector spring and is held releasably secure in this cocked position by the trigger assembly;

means for returning said ejector plate to its seated position; and means to lower and raise said breechblock.

5. A firearm mechanism having a chamber for receiving a cartridge with a percussion sensitive primer and having a firing pin which is disposed to selectively strike the primer of said cartridge thereby firing said cartridge, said firearm mechanism further comprising:

a massive pin block disposed to drive said firing pin whereby, once set in motion, the momentum developed in said pin block serves to drive said firing pin into impact with said primer and thereby fire said cartridge;

a main spring engaging said massive pin block whereby the pin block is set in motion;

means to cock said pin block; and a trigger assembly whereby said pin block is first held in a cocked position against the force of said main spring, then released at a selected time, said trigger assembly comprising:

a notch in said pin block;

a stationary post receivable in said notch whereby said pin block is releasably securable in a cocked position; and a trigger prod attached directly to said pin block whereby said pin block is selectively pushed upward, disengaging said notch from said post, thereby releasing said pin block and allowing said pin block to spring forward under the force of said main spring.

6. A firearm mechanism having a falling breechblock action, a chamber for receiving a cartridge with a percussion sensitive primer and a firing pin disposed to selectively strike the primer of said cartridge thereby firing said cartridge, said firearm mechanism further comprising:

a massive pin block disposed to drive said firing pin whereby, once set in motion, the momentum developed in said pin block serves to drive said firing pin into impact with said primer and thereby fire said cartridge;

a main spring engaging said massive pin block whereby the pin block is set in motion;

a trigger assembly whereby said pin block is first held in a cocked position against the force of said main spring, then released at a selected time whereby said firing pin is selectively driven; and means to cock said pin block comprising:

a pin block arm extension of said pin block;

an ejector plate disposed to engage said pin block arm upon ejecting a spent cartridge from said chamber; and means for driving said ejector plate away from its seated position at said chamber.

7. A firearm mechanism constructed in accordance with claim 6 wherein said trigger assembly further comprises:

a notch in said pin block;

a stationary post receivable in said notch whereby said pin block is releasably securable in a cocked position; and a trigger prod attached directly to said pin block whereby said pin block is selectively pushed upward, disengaging said notch from said post, thereby releasing said pin block and allowing said pin block to spring forward under the force of said main spring.

* * * * *